US010472848B2

(12) United States Patent
Rossi

(10) Patent No.: US 10,472,848 B2
(45) Date of Patent: Nov. 12, 2019

(54) FUNERARY CONSTRUCTION FOR CONTAINING FUNERARY OBJECTS

(71) Applicant: BIONDAN NORTH AMERICA INC., Toronto, Ontario (CA)

(72) Inventor: Filippo Rossi, Isola Della Scala (IT)

(73) Assignee: BIONDAN NORTH AMERICA INC., Toronto, Ontario (CA)

( * ) Notice: Subject to any disclaimer, the term of this patent is extended or adjusted under 35 U.S.C. 154(b) by 0 days.

(21) Appl. No.: 15/933,674

(22) Filed: Mar. 23, 2018

(65) Prior Publication Data

US 2018/0209164 A1 Jul. 26, 2018

Related U.S. Application Data

(62) Division of application No. 15/409,703, filed on Jan. 19, 2017, now abandoned.

(51) Int. Cl.
*E04H 13/00* (2006.01)

(52) U.S. Cl.
CPC ..... *E04H 13/006* (2013.01); *E04H 13/008* (2013.01)

(58) Field of Classification Search
CPC ..... E04H 13/006; E04H 13/008; A61G 17/08
See application file for complete search history.

(56) References Cited

U.S. PATENT DOCUMENTS 2,814,942 A 12/1957 Sinner et al.
2,853,870 A 9/1958 Sinner et al.
2,860,504 A 11/1958 Sinner et al.
3,754,805 A 8/1973 Pangburn et al.
3,888,055 A * 6/1975 Gallo ..... E04H 13/006 52/136
3,905,169 A 9/1975 Gallo
4,484,422 A 11/1984 Roberts
4,519,173 A 5/1985 Roberts
4,644,711 A * 2/1987 Eickhof ..... E04H 13/006 52/126.7
5,195,812 A * 3/1993 Eickhof ..... A47B 47/0091 312/257.1
7,926,228 B1 4/2011 Snow
8,438,794 B2 5/2013 Eickhof
8,833,017 B1 9/2014 Huang
2008/0078074 A1 4/2008 McCampbell
2010/0165639 A1 7/2010 Skeele
2010/0300016 A1* 12/2010 Eickhof ..... E04H 13/006 52/136
2012/0042489 A1 2/2012 Cai
(Continued)

*Primary Examiner* — Brian D Mattei

(74) *Attorney, Agent, or Firm* — Scully, Scott, Murphy & Presser, P.C.

(57) ABSTRACT

A funerary construction for containing funerary objects, which comprises a supporting structure with at least one cavity defined for accommodating at least one funerary object; the accommodation cavity has at least one access opening which is closed by at least one closing plate fixed to the supporting structure; at least one covering slab is arranged facing the closing plate and there are elements of mounting the covering slab on the supporting structure; the mounting elements comprise at least one mounting element that is supported by the closing plate and which defines at least one region for resting the covering slab.

13 Claims, 12 Drawing Sheets

(56) References Cited

U.S. PATENT DOCUMENTS

| | | | | |
|---|---|---|---|---|
| 2012/0167488 | A1* | 7/2012 | Eickhof | E04H 13/006 52/139 |
| 2013/0199111 | A1 | 8/2013 | Eickhof et al. | |
| 2016/0356055 | A1 | 12/2016 | Trousil | |
| 2017/0089091 | A1 | 3/2017 | Young et al. | |
| 2017/0183889 | A1 | 6/2017 | Rossi | |
| 2017/0211291 | A1* | 7/2017 | Eickhof | A61G 17/08 |
| 2018/0179778 | A1* | 6/2018 | Tollefson | E04H 13/003 |

* cited by examiner

FUNERARY CONSTRUCTION FOR CONTAINING FUNERARY OBJECTS

CROSS REFERENCE TO RELATED APPLICATIONS

This application is a divisional of U.S. patent application Ser. No. 15/409,703, filed Jan. 19, 2017, the entire content and disclosure of which is incorporated herein by reference.

The present invention relates to a funerary construction for containing funerary objects.

Funerary containment constructions are known, for example, columbaria or crypts, in which funerary objects of various types are placed, such as urns, coffins, photograph frames and so on.

Typically, these constructions have a supporting structure, which can be made of concrete or of metallic material, in which at least one cavity is defined for accommodating the funerary objects, which has an access opening, which is usually closed by a metallic plate which in turn is covered with a covering slab made of stone-like material, such as marble or the like.

As is known, anchoring the covering slab to the supporting structure of the construction can be done by way of mounting devices that are hidden behind the body of the covering plate so as not to be visible from outside.

In particular, from U.S. Pat. No. 8,438,794 a columbarium is known which is constituted by a framework composed of uprights and horizontal members, which define a plurality of niches, in front of which respective covering slabs of stone are arranged which are removably coupled to the horizontal elements of the framework by way of a hidden mounting system supported by the framework proper.

More specifically, the solution disclosed in the above mentioned patent entails that the hidden mounting system used for each niche is composed of an upper retention element, supported by an upper horizontal member, and of at least one lower coupling support, supported by a lower horizontal member, which cooperate respectively with an upper clip and with at least one lower hook which are associated with the rear face of the covering slab so as to allow an adjustment of the position of the covering slab with respect to the horizontal members.

Such solution has the disadvantage of requiring a laborious manual intervention by workmen in order to mount each covering slab and adjust it in position.

Furthermore, it requires that the operators carry out the adjustment of one covering slab at a time, which entails long execution times.

The aim of the present invention is to provide a funerary construction for containing funerary objects which is capable of improving the known art in one or more of the above mentioned aspects.

Within this aim, an object of the invention is to provide a funerary construction for containing funerary objects that enables an easy, convenient and rapid mounting of covering slabs.

Another object of the invention is to provide a funerary construction for containing funerary objects that makes it possible to perform, simply and extremely easily, the adjustment of the position of the covering slabs to be mounted.

Another object of the invention is to provide a funerary construction for containing funerary objects, which is provided with means of mounting that make it possible to obtain a high level of precision in the positioning of the covering slabs, but requiring reduced installation times with respect to conventional systems.

Another object of the present invention is to provide a funerary construction for containing funerary objects that is capable of offering the highest guarantees of safety and reliability in use.

Furthermore, another object of the present invention is to overcome the drawbacks of the known art in a different manner to any existing solutions.

Another object of the invention is to provide a funerary construction that is relatively easy to implement and which can be made at low cost.

This aim and these and other objects which will become better apparent hereinafter are achieved by a funerary construction for containing funerary objects according to claim 1.

Further characteristics and advantages of the invention will become better apparent from the description of some preferred, but not exclusive, embodiments of the funerary construction for containing funerary objects according to the invention, which are illustrated for the purposes of non-limiting example in the accompanying drawings wherein.

Figure 1:
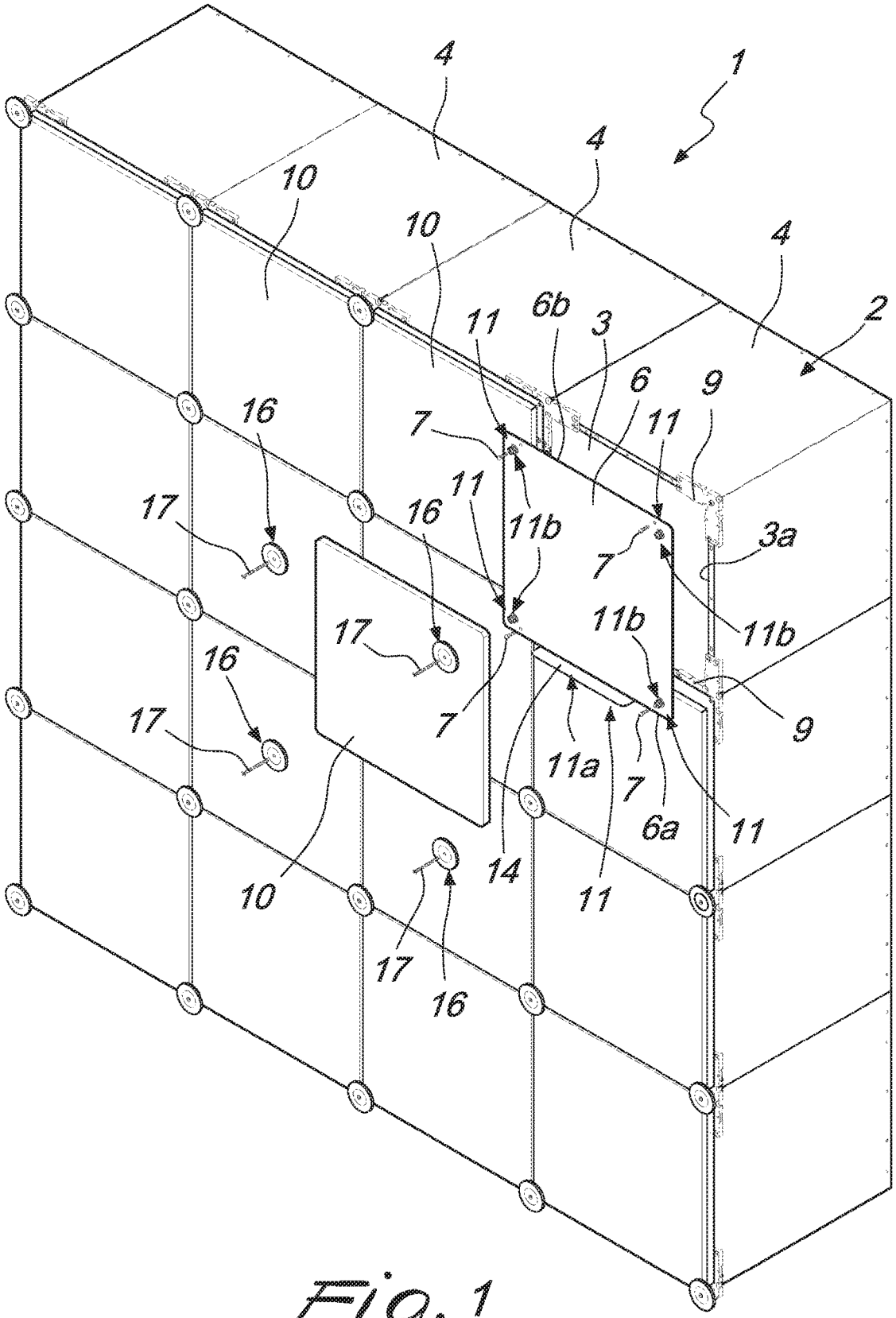
FIG. 1 is a partially exploded perspective view of a first embodiment of the funerary construction according to the invention.
Figure 2:
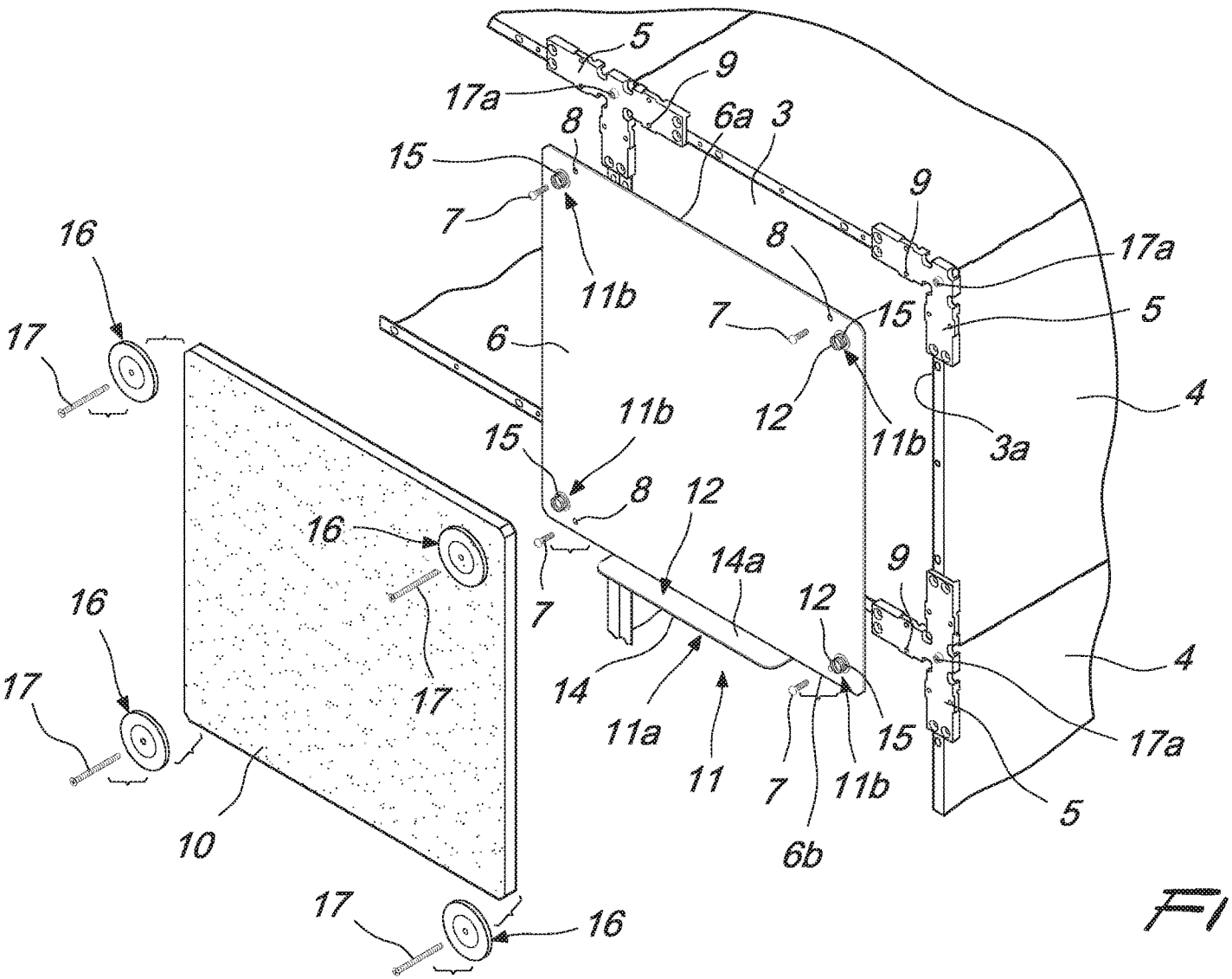
FIG. 2 is an exploded perspective view of some components of the embodiment of FIG. 1.
Figure 3:
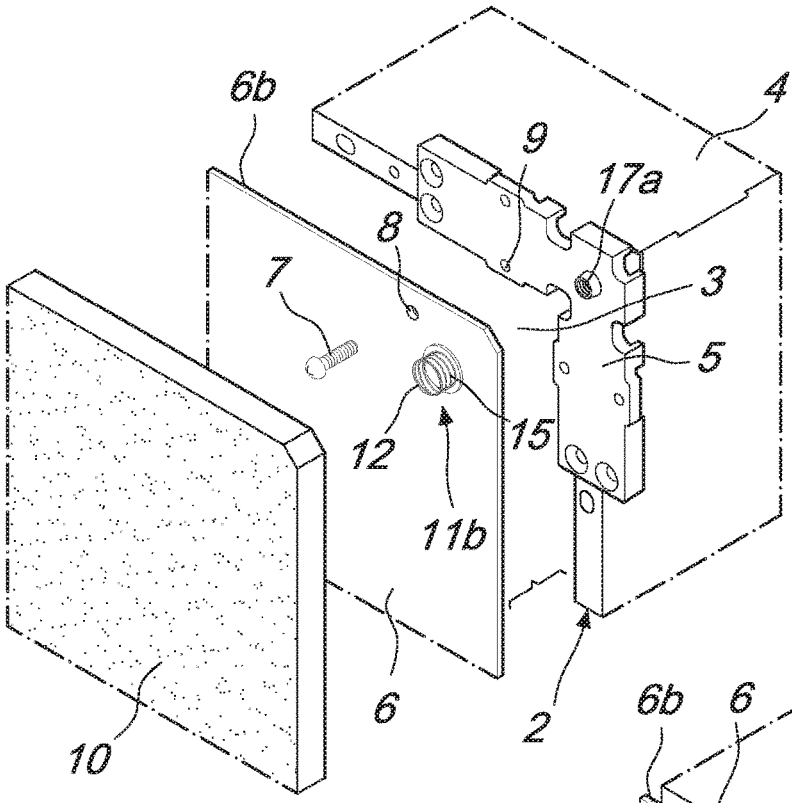
FIGS. 3, 4 and 5 show, partially, in perspective and exploded views, the funerary construction according to the invention, in its first embodiment, in a sequence of steps of mounting.
Figure 4:
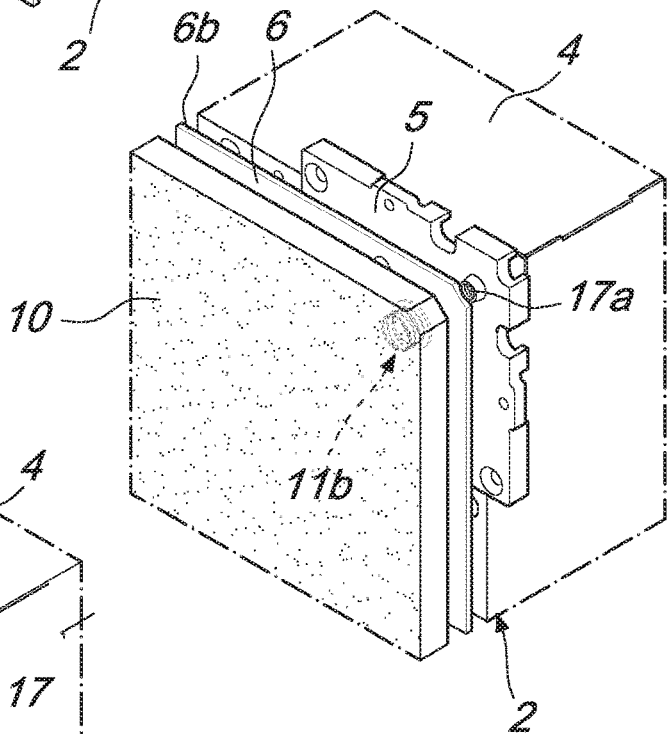
Figure 5:
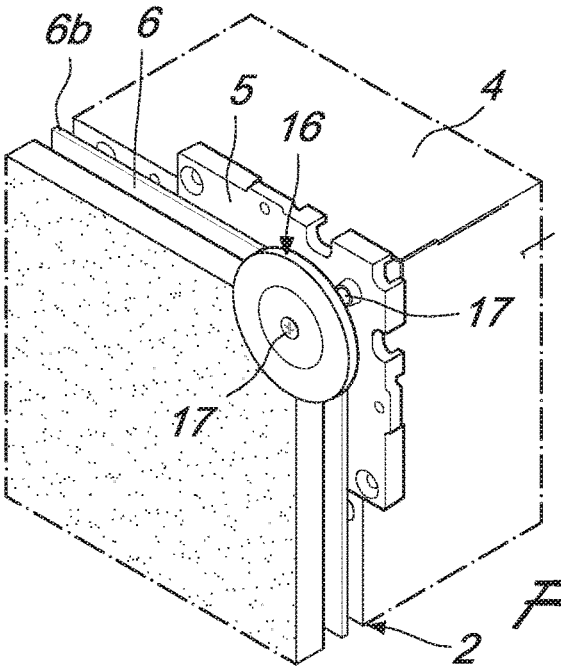
Figure 6:
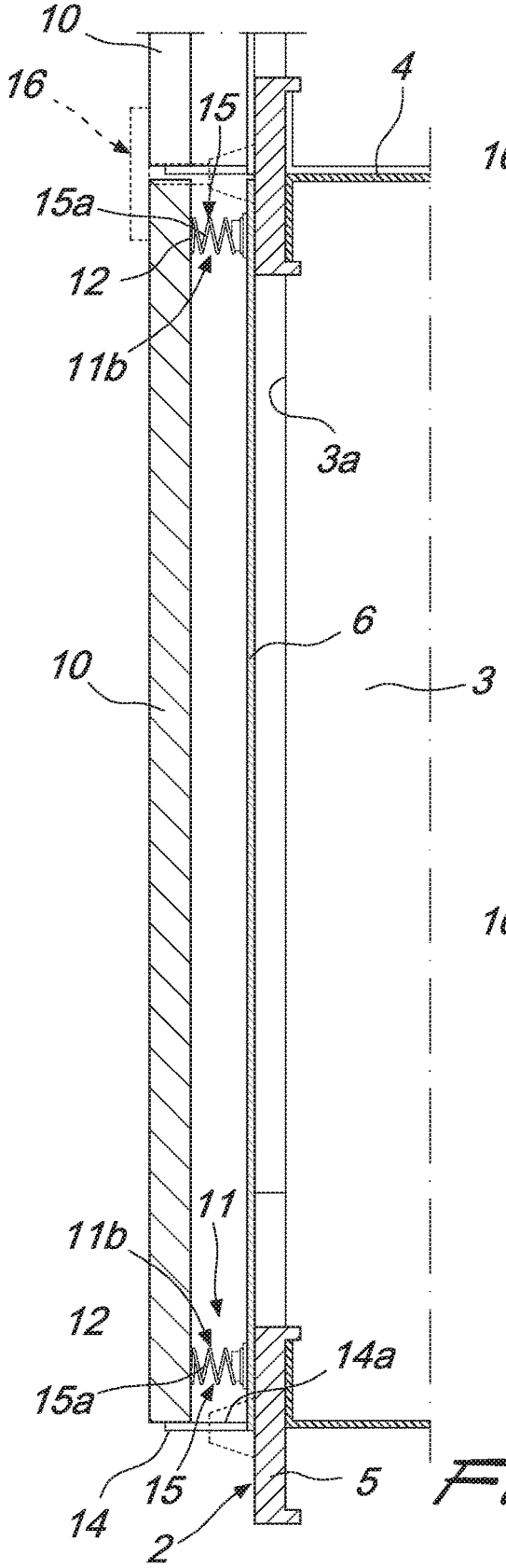
FIG. 6 is a partial cross-sectional view, taken along a vertical plane, of the funerary construction according to the invention in its first embodiment.
Figure 7:
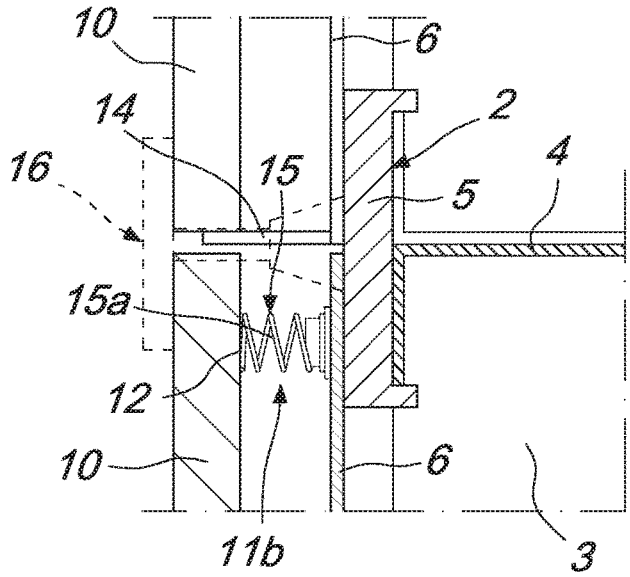
FIG. 7 is a detail of FIG. 6.
Figure 8:
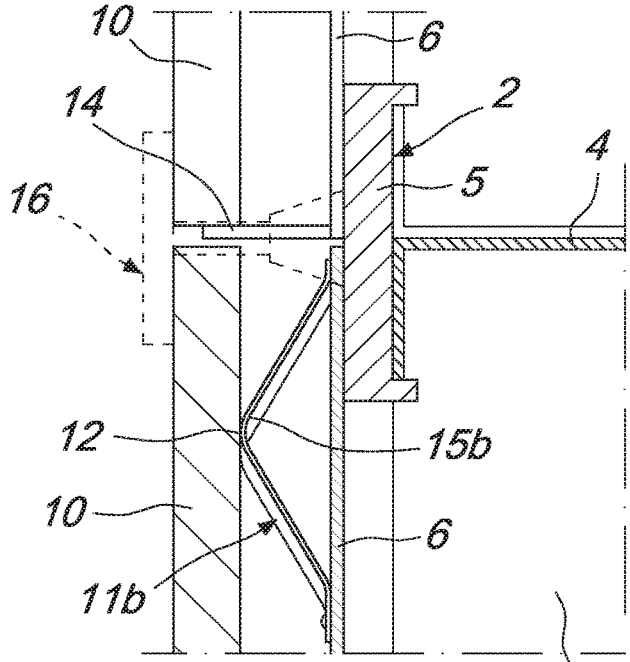
FIG. 8 is a cross-sectional view of a possible variation of embodiment of elastic means of the first embodiment.

With reference to the figures, the funerary construction for containing funerary objects according to the invention, generally designated by the reference numeral 1, comprises a supporting structure 2 which is provided with at least one cavity 3 or niche for accommodating at least one funerary object, such as, for example, a funerary urn, a coffin, a photograph frame and so on.

The accommodation cavity 3 has at least one access opening 3*a* which is defined on at least one side of the supporting structure 2.

Figure 9:
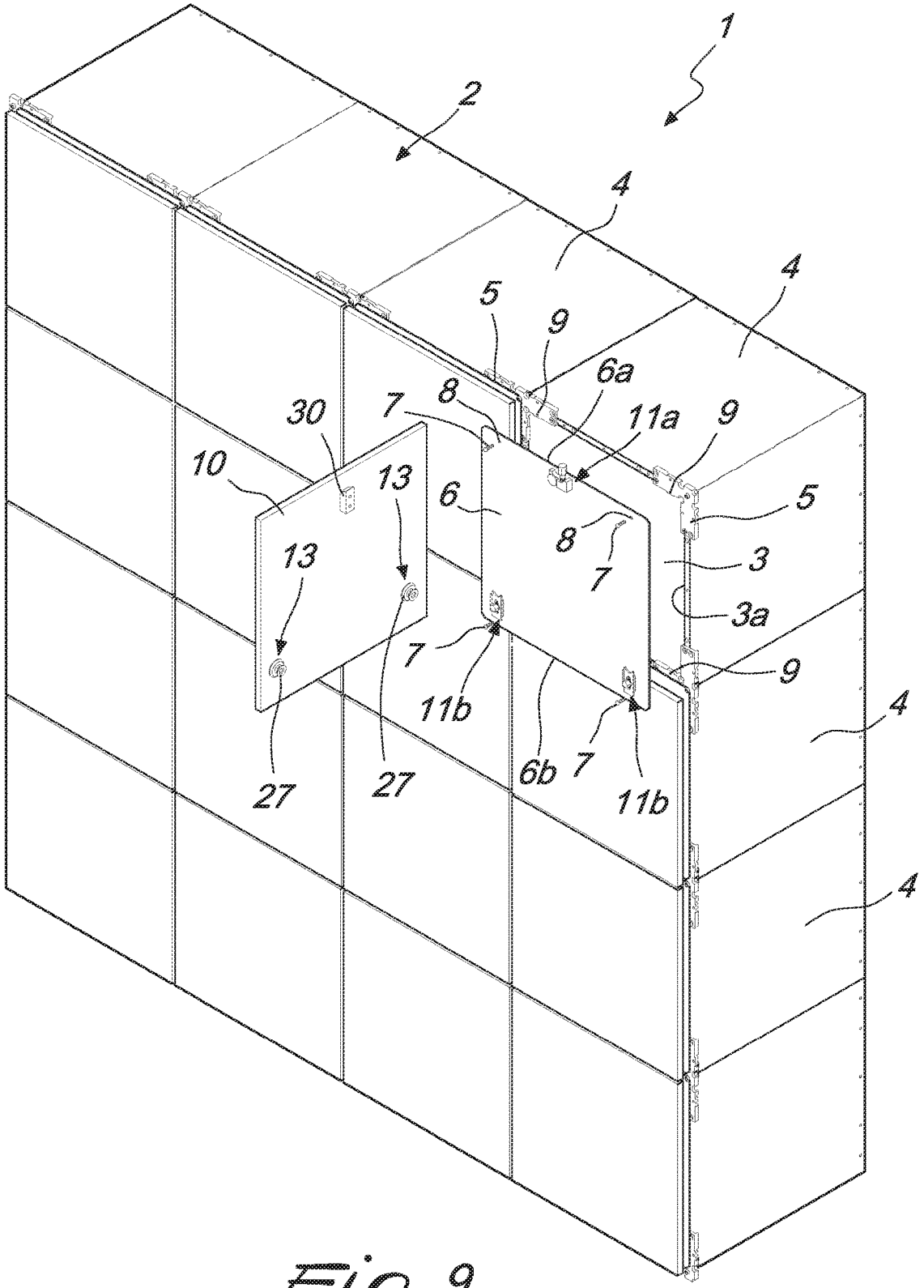
FIG. 9 is a partially exploded perspective view of a second embodiment of the funerary construction according to the invention.
Figure 10:
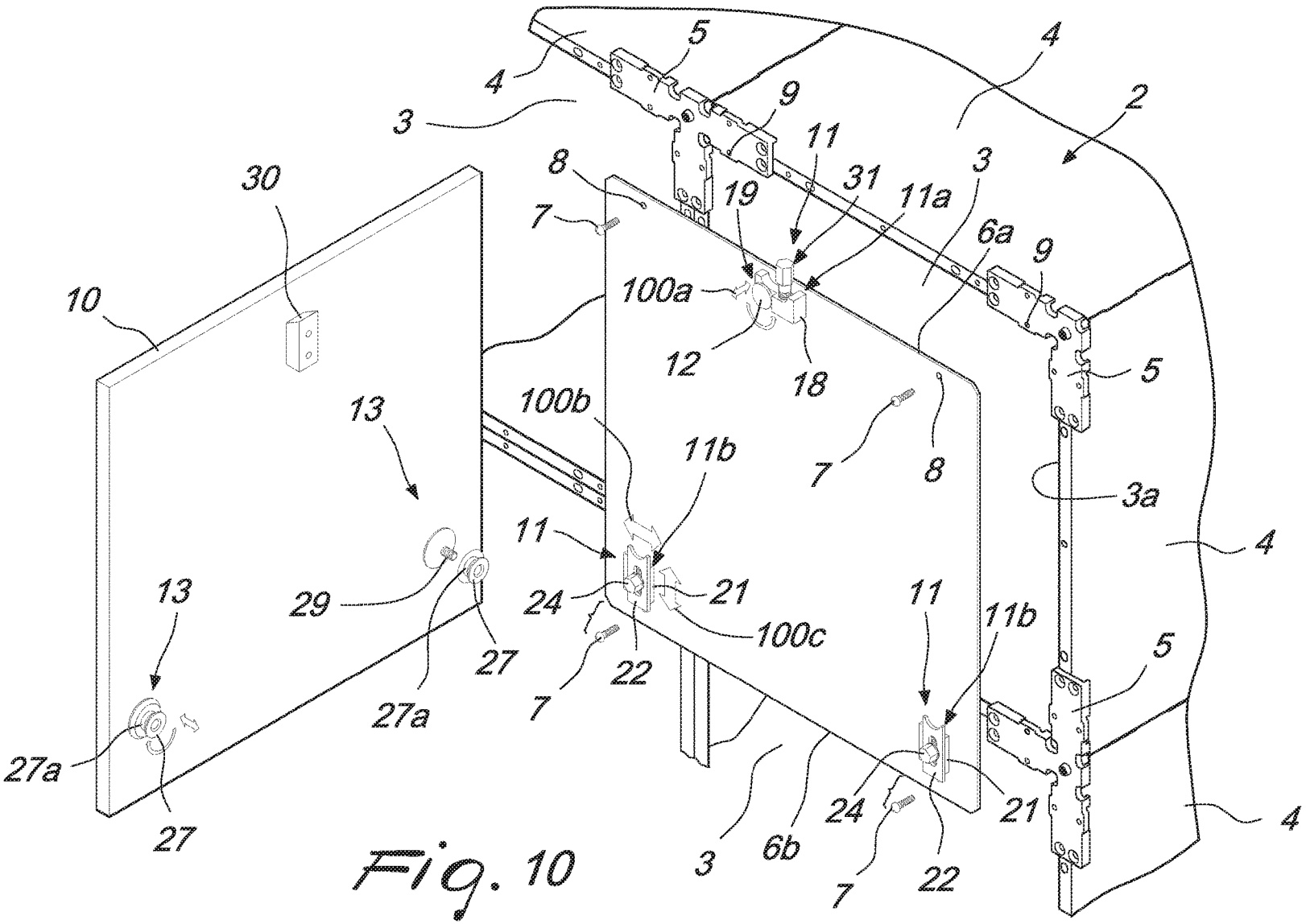
FIG. 10 is an exploded perspective view of a portion of the funerary construction according to the invention in the second embodiment.
Figure 11:
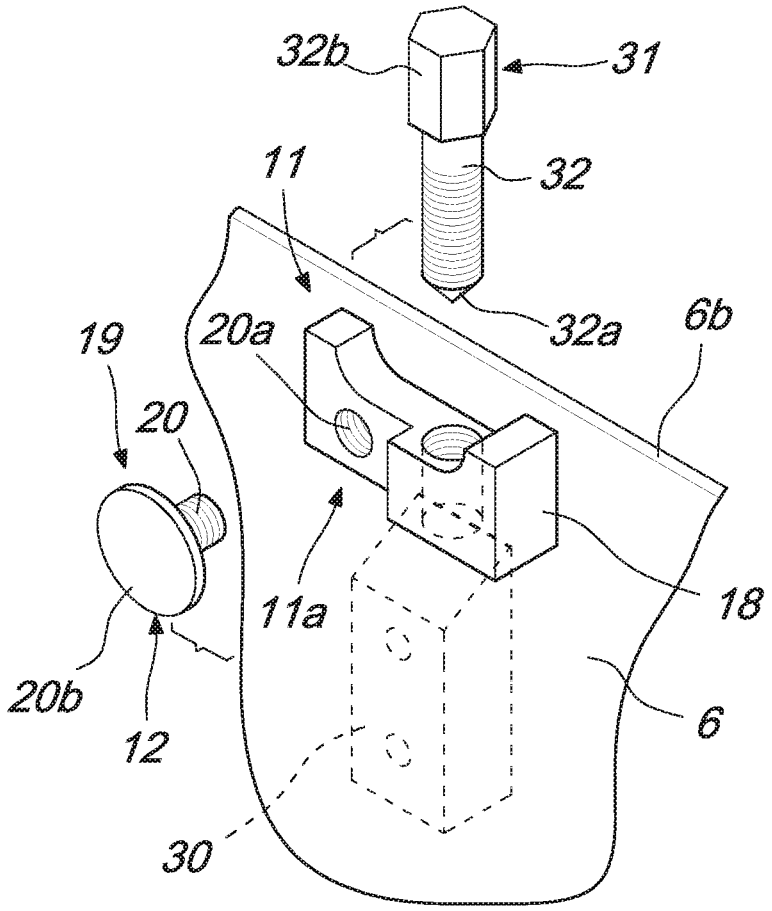
FIG. 11 is an exploded perspective view of a first mounting element of the second embodiment of the invention.
Figure 12:
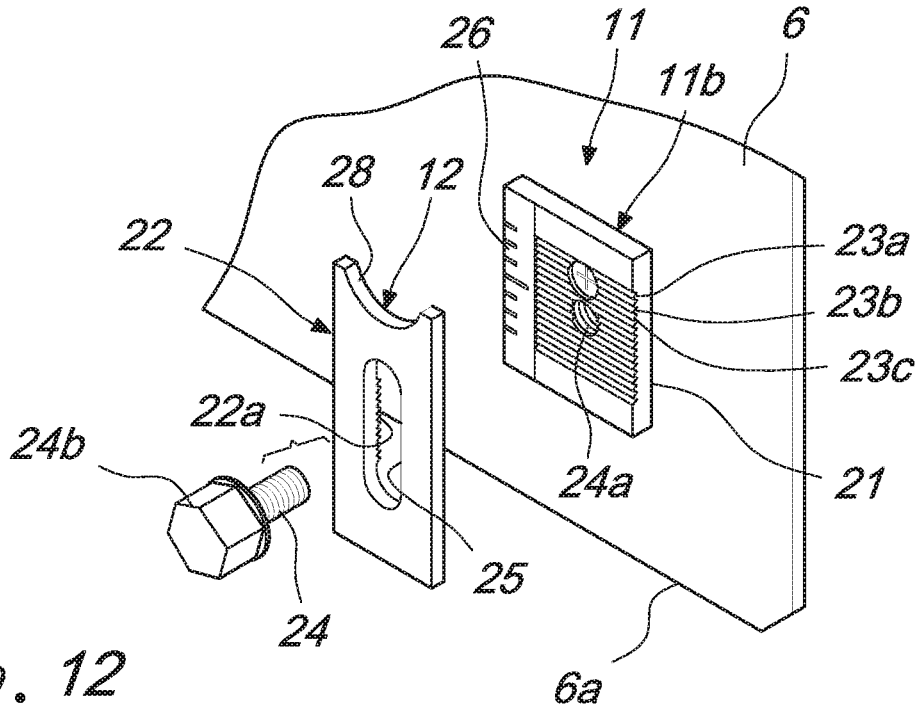
FIG. 12 is an exploded perspective view of a second mounting element of the second embodiment of the invention.
Figure 13:
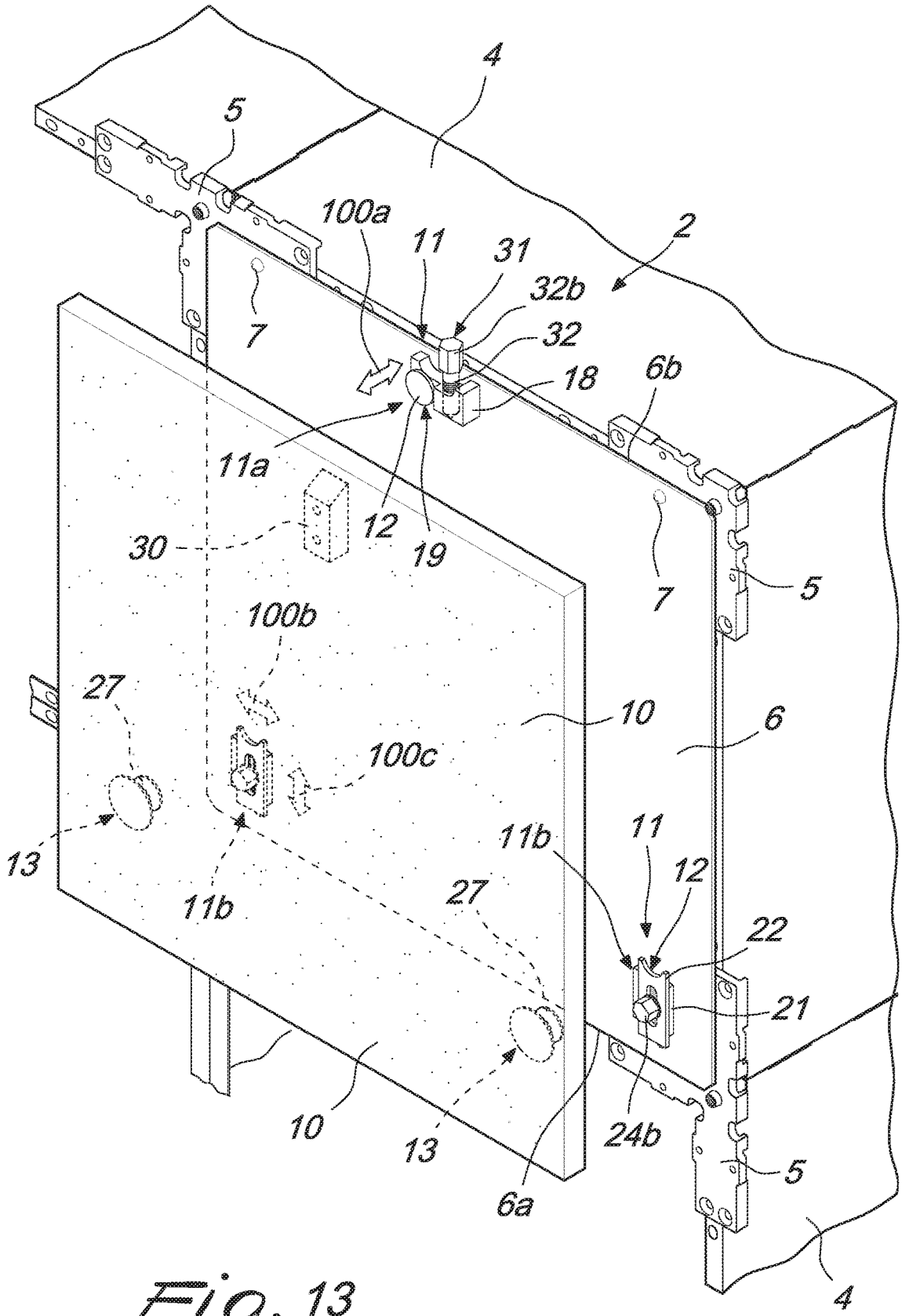
FIG. 13 is a partially exploded perspective view of a portion of the funerary construction according to the invention in the second embodiment.
Figure 14:
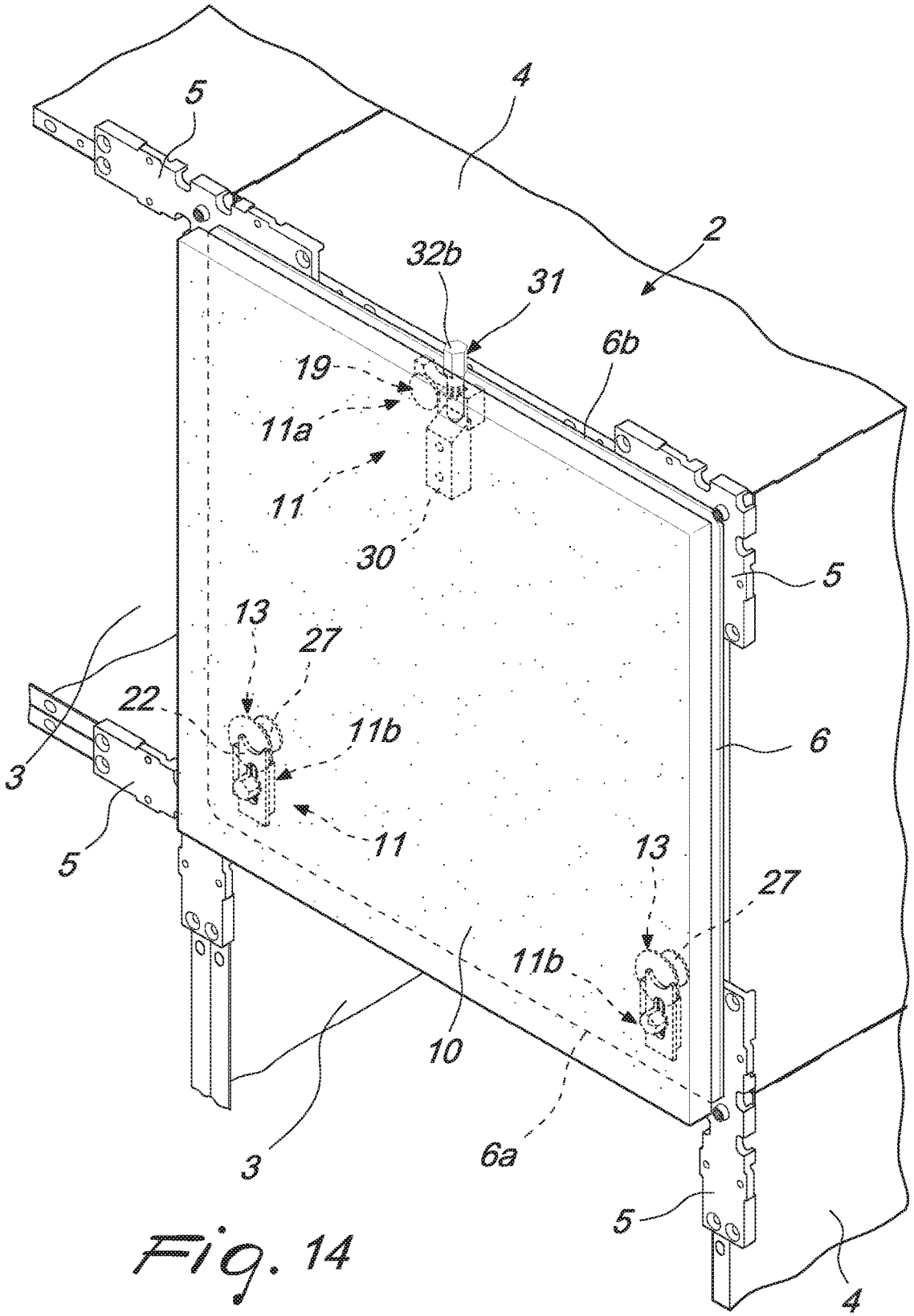
FIG. 14 is a perspective view of a portion of the funerary construction according to the invention in the second embodiment, with parts omitted for the sake of simplicity.
Figure 15:
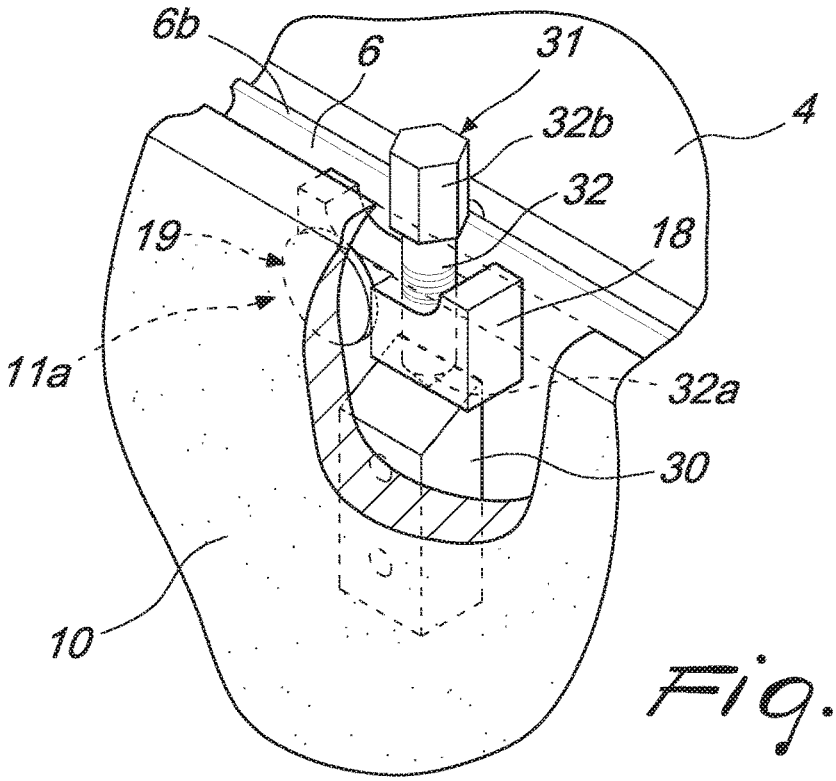
FIG. 15 is a perspective and partially cutaway view of a detail of the second embodiment of the funerary construction according to the invention.
Figure 16:
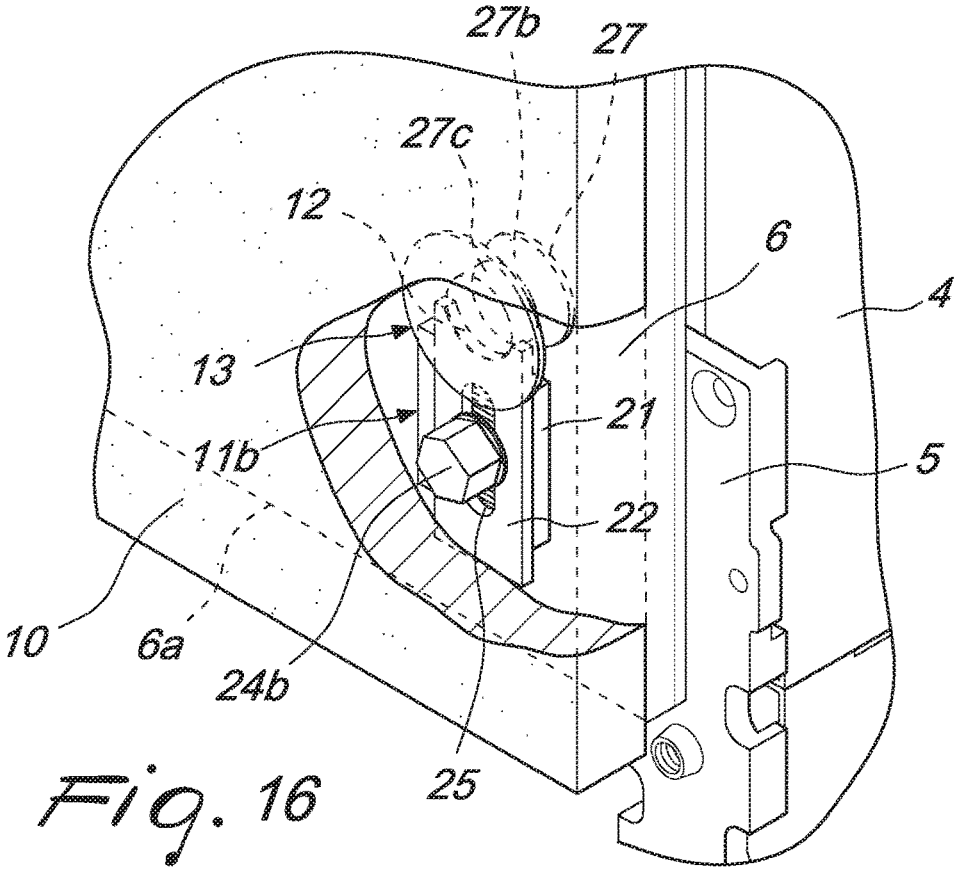
FIG. 16 is a perspective and partially cutaway view of another detail of the second embodiment of the funerary construction according to the invention.
Figure 17:
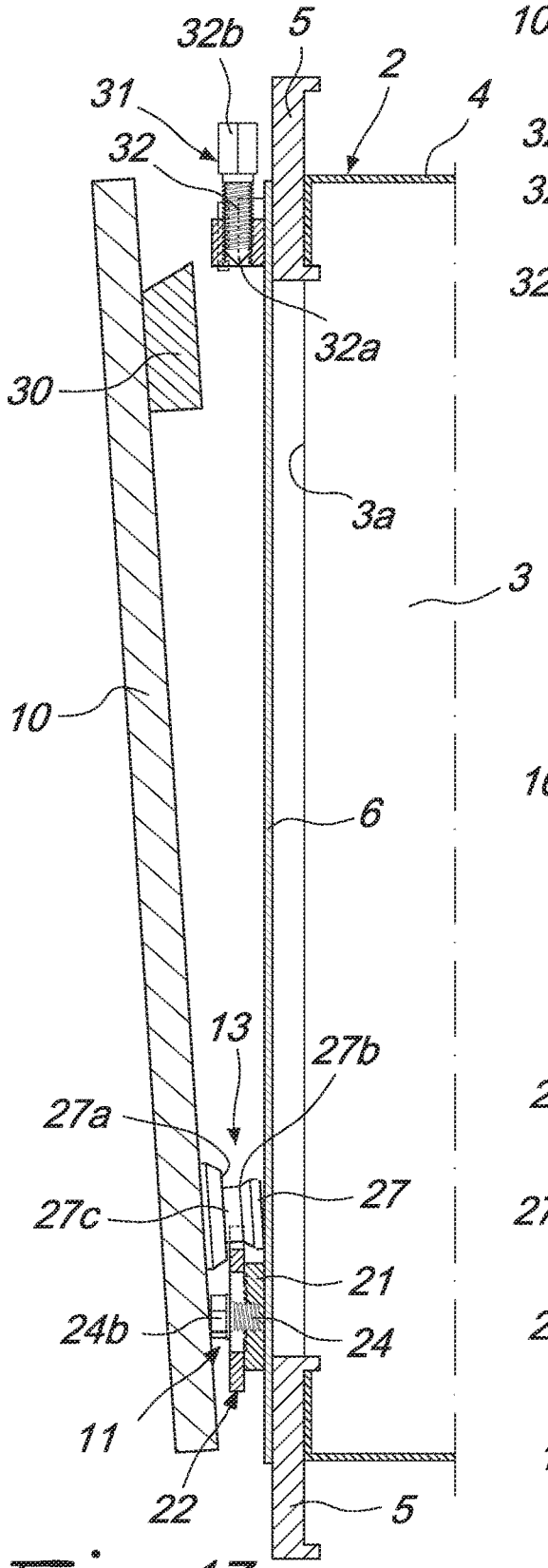
FIG. 17 is a partial cross-sectional view, taken along a vertical plane, of the second embodiment of the funerary construction according to the invention, in a step of mounting.
Figure 18:
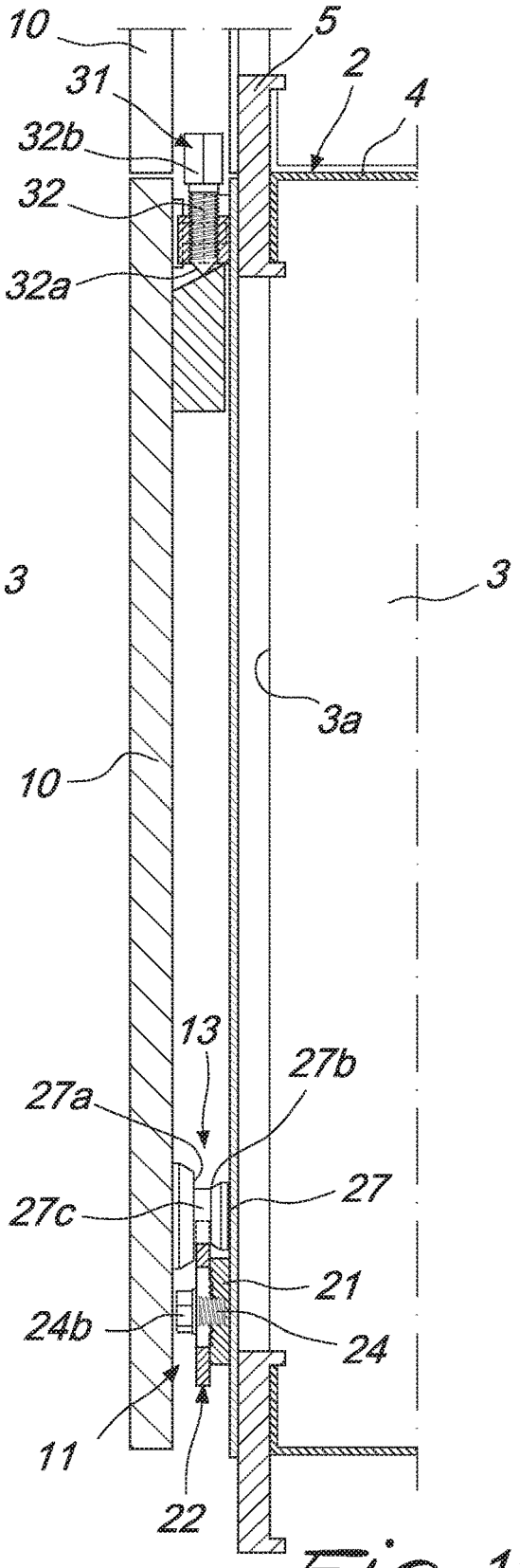
FIG. 18 is a partial cross-sectional view, taken along a vertical plane, of the second embodiment of the funerary construction according to the invention, once mounted.
Figure 19:
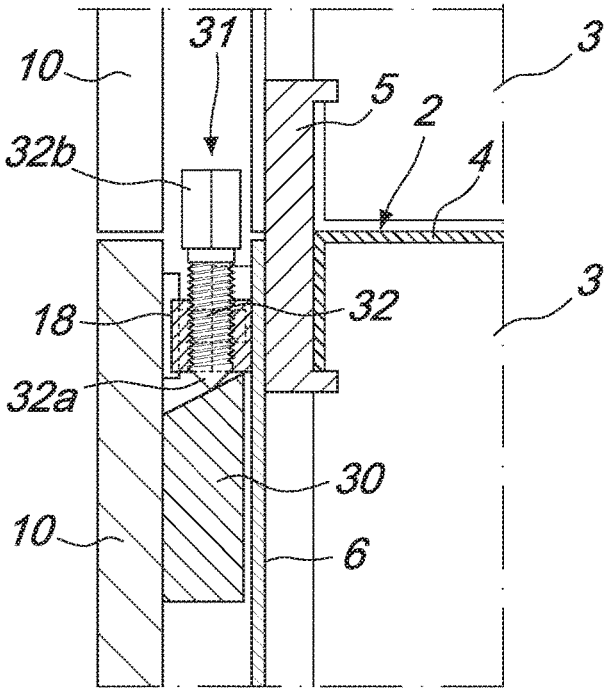
FIG. 19 is a cross-sectional view of the retention means of the second embodiment of the invention.
Figure 20:
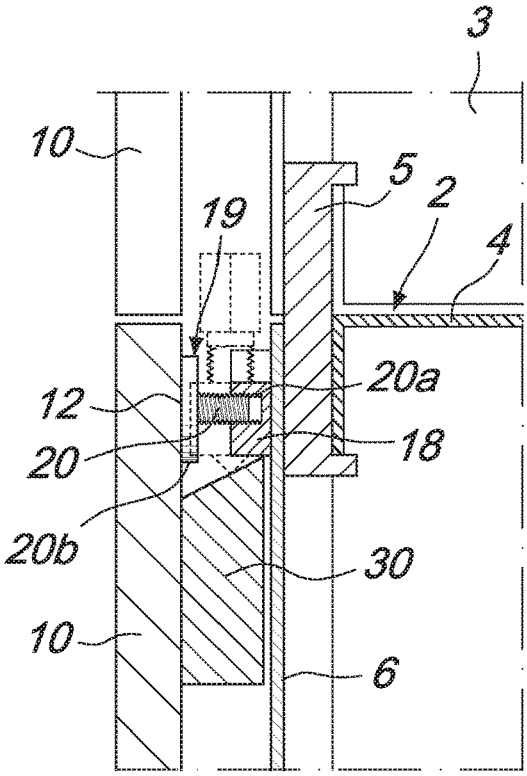
FIG. 20 is a cross-sectional view of the first mounting element of the second embodiment of the funerary construction according to the invention.
Figure 21:
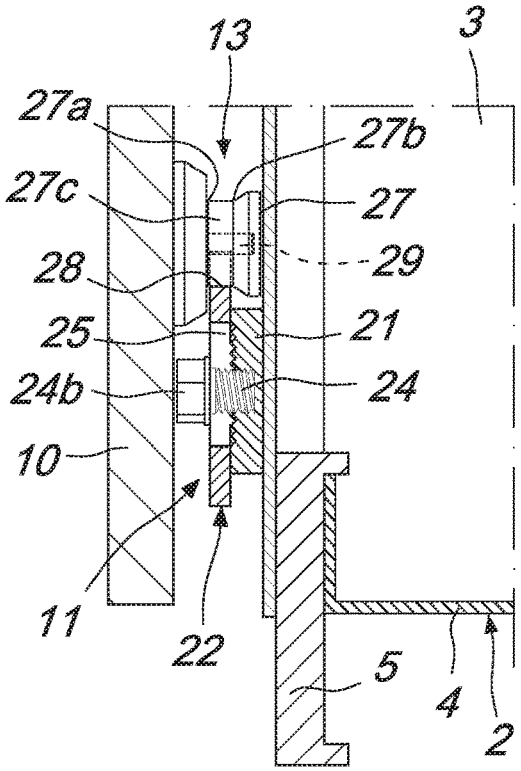
FIG. 21 is a cross-sectional view of a second mounting element of the second embodiment of the funerary construction according to the invention.

For example, the supporting structure 2 can be provided by way of a plurality of box-like enclosures 4, each one of which internally defines a respective accommodation cavity 3 and which are mutually arranged in vertical columns and horizontal rows, as illustrated, for example, in FIGS. 1 and 9. Conveniently, the box-like enclosures 4 can be made of sheet metal and can be mutually interconnected by corner join elements 5, substantially right-angled or L-shaped, or cross-shaped, or T-shaped, and fixed to the corners of the box-like enclosures 4 by way of screw elements or the like.

Alternatively, the supporting structure 2 can be made of concrete or masonry or other suitable materials.

The access opening 3*a* of the, or each, accommodation cavity 3 is closed by way of at least one closing plate 6 which is fixed to the supporting structure 2.

The fixing of the closing plate 6 to the supporting structure 2 can be performed by way of screws 7 that engage respective through holes 8, which are defined in the closing plate 6, and corresponding screwing seats 9, which are defined, for example, in the box-like enclosures 4 or, as in the figures, in the corner join elements 5 or in anchoring blocks inserted into the supporting structure 2, if the latter is made, in particular, of concrete or masonry.

Facing the closing plate 6 is at least one covering slab 10 which is made, for example, of stone-like material, such as marble, granite or the like, and which is coupled or in any case connected, in general, to the supporting structure 2 by way of means of mounting.

According to the invention, the means of mounting comprise one or more mounting elements 11, which are supported by the closing plate 6 and which define at least one respective region 12 for resting the covering slab 10.

Advantageously, the mounting elements 11 have means of adjusting the position of the corresponding resting region 12 along at least one direction, in order to be capable of varying, during the installation, the position of the covering slab 10 with respect to the supporting structure 2.

Optionally, it is possible for the mounting means to also comprise one or more anchoring elements 13, which are associated with the face of the covering slab 10 that is directed toward the closing plate 6 and which interact with the regions 12 for resting the mounting elements 11.

Descending into the details, the mounting means can, conveniently, comprise at least one first mounting element 11*a*, which can be arranged proximate to an edge 6*a* of the closing plate 6, and at least one second mounting element 11*b*, which can be, advantageously, positioned proximate to the opposite edge 6*b* of the closing plate 6 with respect to the edge proximate to which the first mounting element 11*a* is arranged.

For example, according to a possible embodiment, there can be at least two second mounting elements 11*b* arranged mutually spaced apart along the edge 6*b* of the closing plate 6.

Alternatively, there can be a plurality of second mounting elements 11*b* arranged at corner areas of the closing plate 6.

Conveniently, there are further retention means, the function of which is to immobilize the covering slab 10, with respect to the closing plate 6, in the desired position, as will be better described below.

With reference to a first embodiment, shown in FIGS. 1-8, the first mounting element 11*a* can be constituted by a tab 14 that protrudes substantially at right angles from an edge 6*a* of the closing plate 6 and which defines, with its face 14*a* directed toward the closing plate 6, the region 12 for resting the first mounting element 11*a* for the covering slab 10.

In particular, the tab 14 is preferably protruding from the lower edge of the closing plate 6 and the covering slab 10 is, conveniently, placed to rest against the face 14*a* of the tab 14, with its lower edge, so as to be movable, in one direction or in the other direction, along at least one direction substantially parallel to the face 14*a* of the tab 14.

As shown in the figures, in this first embodiment, there are advantageously multiple second mounting elements 11*b* arranged in the corner areas of the closing plate 6, and each second mounting element 11*b* comprises, in this case, elastic means 15 which act between the closing plate 6 and the corresponding region 12 for resting the covering slab 10.

More specifically, the elastic means 15 of each second mounting element 11*b* can be constituted by a helical spring 15*a*, which is coupled, at one end, to the closing plate 6 and which defines, at the other end, the resting region 12 against which the face of the covering slab 10 directed toward the closing plate 6 rests.

Alternatively, the elastic means 15 can be provided by elastic laminas 15*b*, which are coupled, with at least one end thereof, to the closing plate 6 and which define with a portion thereof the region 12 for resting the face of the covering slab 10 directed toward the closing plate 6.

In this first embodiment, the covering slab 10, which is kept resting against the resting regions 12 defined by the elastic means 15 and by the face 14*a* of the tab 14, can be moved, in order to adjust its position, along a direction perpendicular to the closing plate 6, in contrast with or by the action of the elastic means 15 of the second mounting elements 11*b*, and along a direction parallel to the face 14*a* of the tab 14 and parallel to the closing plate 6.

Also in the first embodiment, the retention means can comprise abutment elements 16, constituted for example by washers or the like, which are adapted to engage the face of the covering slab 10 that is on the opposite side with respect to the closing plate 6, preferably, but not necessarily, at its corners, and which are connected, by way of respective threaded elements 17, to the supporting structure 2.

In particular, the threaded elements 17 are coupled to respective engagement holes 17*a* that are defined in the supporting structure 2, for example at the corner join elements 5 or at anchoring blocks inserted into holes provided in the supporting structure 2, if the latter is made of concrete or masonry.

In this manner, by screwing or unscrewing the threaded elements 17 in the corresponding engagement seats 17*a*, it is possible to produce, at least in the various points where the abutment elements 16 are present, a variation of the position of the covering slab 10 along a direction substantially perpendicular to the closing plate 6, in contrast with or in agreement with the action of the elastic means 15 on which the covering slab 10 rests, so as to obtain the desired arrangement of the covering slab 10.

In a second embodiment, shown in FIGS. 9-21, there is at least one first mounting element 11*a* arranged proximate to an edge 6*a* of the closing plate 6, while proximate to the opposite edge 6*b* of the closing plate 6 with respect to the edge 6*a* there is at least one second mounting element 11*b* and, more preferably, there are at least two second mounting elements 11*b* which are mutually spaced apart along the edge 6*b*.

Conveniently, in this second embodiment, the first mounting element 11*a* can be arranged proximate to the upper edge of the closing plate 6, and there can be two second mounting elements 11*b* arranged proximate to the lower edge of the closing plate 6.

Also with reference to the second embodiment, the first mounting element 11*a* comprises a supporting body 18, which is fixed to the closing plate 6, and at least one first adjustment element 19 which is associated with the supporting body 18 and which defines the region 12 for resting the covering slab 10 of the first mounting element 11*a*.

In particular, the first adjustment element 19 is adjustably movable along a direction 100*a* substantially perpendicular to the closing plate 6, in order to make it possible to vary, during the installation, the distance of the corresponding resting region 12 and, therefore, of the covering slab 10, from the closing plate 6.

As illustrated, the first adjustment element 19 can comprise a threaded shaft 20, which is coupled to a threaded seat 20*a* defined in the supporting body 18 and is arranged with its axis substantially at right angles to the closing plate 6. The threaded shaft 20 has, at one end, a head 20*b* that defines the region 12 for resting the first mounting element 11*a* for the covering slab 10, so that, by screwing or unscrewing it in the threaded seat 20*a*, it is possible to vary the position of the covering slab along the direction 100*a* substantially perpendicular to the closing plate 6.

In the second embodiment, the (or each) second mounting element 11*b* comprises a base 21, which is fixed to the closing plate 6, and at least one corresponding second adjustment element 22 which defines the corresponding region 12 for resting the covering slab 10. The second adjustment element 22 is slideably movable with respect to the base 21 along at least two directions of adjustment 100*b* and 100*c*, which are mutually perpendicular and are parallel to the closing plate 6.

As illustrated, the second adjustment element 22 of each second mounting element 11*b* comprises, advantageously, a plate-like slider coupled slideably on the base 21, and the base 21 defines, for the second adjustment element 22, a plurality of engagement regions 23*a*, 23*b*, 23*c* which are mutually spaced apart along at least one of the two directions of adjustment 100*b* and 100*c*.

The engagement regions 23*a*, 23*b* and 23*c* are, for example, provided by a toothed rack, defined on the face of the base 21 directed toward the covering slab 10, which extends along one of the two directions of adjustment, for example the one designated with 100*c*, with an alternation of teeth and grooves that are removably engageable in sequence by a corresponding toothing 22*a*, integrally defined on the second adjustment element 22, upon its sliding along the direction of adjustment 100*c*, while the second adjustment element 22 is substantially free to slide in the other direction of adjustment 100*b*, thanks to the sliding of the teeth of the toothing 22*a* of the second adjustment element 22 along the longitudinal extension of the grooves of the toothed rack of the base 21.

Conveniently, the second adjustment element 22 can be blocked with respect to the base 21 by way of a screw 24 coupled to a female thread seat 24*a* defined in the base 21 and passing through a slot 25 that is defined in the second adjustment element 22 and which extends for example along the adjustment direction designated with 100*c*. In particular, the screw 24 passes through the slot 25 with play both in the direction of longitudinal extension of the slot proper and in its direction of transverse extension and it has, at one end, a tightening head 24*b* that engages the face of the second adjustment element 22 directed away from the base 21 along the longitudinal edges of the slot 25. Screwing the screw 24 in its female thread seat 24*a* makes it possible to block, in the desired position, the second adjustment element 22 with respect to the base 21, while unscrewing it makes it possible to free the second adjustment element 22 from the clamping of the screw 24 and to consequently release its possibility to slide along the two directions of adjustment 100*b*, 100*c*, by virtue of the play present between the screw 24 and the slot 25, so as to be able to vary the position of the corresponding region 12 for resting the covering slab 10.

Conveniently, on the base 21 there can be notches 26 for indicating the position of the second adjustment element 22 with respect to the base 21 along at least one of the two directions of adjustment 100*b*, 100*c*.

In the second embodiment, there are, furthermore, one or more anchoring elements 13 associated with the covering slab 10, which comprise, respectively, at least one engagement pin 27, which is constituted, for example, by a latch, and which is arranged, with its axis, substantially at right angles with respect to the covering slab 10, and which is adapted to engage a respective second mounting element 11*b*.

In particular, in the second embodiment, in each second adjustment element 22 an accommodation recess 28 is defined which is capable of receiving in engagement a corresponding engagement pin 27 and which basically provides the region 12 for resting the covering slab 10 of the corresponding second mounting element 11*b*.

More specifically, as in the example shown, the accommodation recess 28 is defined at an upper end of the second adjustment element 22 of each second mounting element 11*b*.

Conveniently, each engagement pin 27 is provided with a pair of abutment shoulders 27*a*, 27*b* for the corresponding second adjustment element 22. The abutment shoulders 27*a*, 27*b* are mutually facing and mutually spaced apart along the axis of the corresponding engagement pin 27.

In particular, each second adjustment element 22 is adapted to engage, with its accommodation recess 28, the corresponding engagement pin 27 along a portion 27*c* of the engagement pin 27 comprised between the abutment shoulders 27*a* and 27*b*.

Advantageously, each engagement pin 27 axially presents a threaded seat coupled to a threaded rod 29 that is integral with the covering slab 10 and which extends substantially at right angles to that covering slab, so that, by screwing or unscrewing it along the threaded rod 29, it is possible to adjust the extent of its protrusion from the covering slab 10 and, therefore, to adjust the distance between the covering slab 10 and the closing plate 6, in the region in which it interacts with the corresponding second mounting element 11*b*.

Still with reference to the second embodiment, the means of retaining the covering slab 10 can, in this case, comprise at least one hook element 30 which is integral with the covering slab 10 and at least one retention element 31, which is supported by the closing plate 6 and is adapted to interact with the hook element 30.

In particular, the retention element 31 can comprise, conveniently, a screw element 32 arranged substantially parallel to the closing plate 6 and engaged with a threaded hole defined in the supporting body 18.

The screw element 32 is adapted to interact with the hook element by way of a conveniently contoured end 32*a* thereof, and can, advantageously, have, at its other end, a polygonal head 32*b*, which can be engaged by a suitable instrument in order to allow, by screwing or unscrewing it in the corresponding threaded hole, the engagement or the disengagement of its end 32*a* with the hook element 30, with consequent blocking or release of the covering slab with respect to the closing plate 6.

Use of the funerary construction, according to the invention, is evident from the foregoing description and explanation.

In particular, with reference to the first embodiment, it is evident that, once the access opening 3*a* of an accommodation cavity 3 is closed by fixing a closing plate 6 to the supporting structure 2, by way of the screws 7, with the tab 14 of the closing plate 6 arranged, for example, in a lower region, the operator can arrange a covering slab 10 in front of the closing plate 6, resting its lower edge against the tab 14, which acts, therefore, as a locator for the subsequent adjustment of its positioning, and its face directed toward the closing plate 6 against the elastic means 15.

The operator will then adjust the position of the covering slab 10 by making it slide on the tab 14 along a direction that is substantially parallel to the closing plate 6, in one direction or the other, i.e. to the right or to the left, and/or along a direction substantially perpendicular to the closing plate 6, in order to vary its distance from the latter.

Once the covering slab 10 is arranged in the desired position, the operator will block the covering slab 10 by way of the abutment elements 16 and, by screwing or unscrewing the corresponding threaded elements 17, the operator can also locally adjust its distance from the closing plate 6.

In the same way, the operator can mount covering slabs 10 at other accommodation cavities 3 of the funerary construction.

With reference to the second embodiment, the operator begins the operation of closing an accommodation cavity 3 by fixing a closing plate 6 to its access opening 3*a*, screwing the screws 7 into the screwing seats 9 defined in the supporting structure 2.

At this point, by way of the first and the second mounting elements 11*a*, 11*b*, the operator will couple a covering slab 10 to the closing plate 6 and adjust its position by way of the first adjustment element 19 and the second adjustment elements 22, and will also adjust the position of the engagement pins 27.

The covering slab 10 is then blocked by engaging the retention element 31 with the hook element 30.

The same adjustment of the first and second adjustment elements 11*a*, 11*b* can be used on the closing plates 6 of all the other accommodation cavities 3, with a consequent considerable reduction of the installation times, the position of the closing plates 6 on the access openings 3*a* of the accommodation cavities 3 being determined by the position of the screwing seats 9 of the screws 7 used to fix the closing plates 6.

In practice it has been found that the invention fully achieves the intended aim and objects, a funerary construction for containing funerary objects being provided that allows, during installation, by virtue of the peculiar mounting means with which it is provided, great precision, rapidity and simplicity in the positioning of the covering slabs of the cavities for accommodating the funerary objects.

The invention thus conceived is susceptible of numerous modifications and variations, all of which are within the scope of the appended claims. Moreover, all the details may be substituted by other, technically equivalent elements.

In practice the materials employed, provided they are compatible with the specific use, and the contingent dimensions and shapes, may be any according to requirements and to the state of the art.

The invention claimed is:

1. A funerary construction for containing funerary objects, which comprises:

a supporting structure with at least one cavity defined for accommodating at least one funerary object, said accommodation cavity having at least one access opening which is defined on at least one side of said supporting structure;

at least one plate for closing said at least one access opening, fixed to said supporting structure;

at least one covering slab arranged facing said closing plate;

means of mounting said covering slab on said supporting structure;

wherein said mounting means comprise at least one mounting element that is supported by said closing plate and which defines at least one respective region for resting said covering slab, wherein said mounting means comprise at least one anchoring element that is associated with the face of said covering slab directed toward said closing plate and which interacts with the region for resting said at least one mounting element, wherein said at least one mounting element comprises at least one first mounting element, arranged proximate to an edge of said closing plate, and at least one second mounting element, said at least one first mounting element and said at least one second mounting element defining at least one respective region for resting said covering slab, wherein said at least one first mounting element comprises a supporting body fixed to said closing plate and at least one first adjustment element that is associated with said supporting body and defines said resting area, said first adjustment element being adjustably movable along a direction substantially perpendicular to said closing plate, wherein said at least one second mounting element comprises a base fixed to said closing plate and at least one second adjustment element that defines said resting region and is slideably movable with respect to said base along at least two directions of adjustment that are mutually perpendicular and are parallel to said closing plate, and wherein said base defines, for said at least one second adjustment element, a plurality of engagement regions that are mutually spaced apart along at least one of said directions of adjustment.

2. The construction according to claim 1, wherein said at least one mounting element has means for adjusting the position of said at least one resting region along at least one direction.

3. The construction according to claim 1, comprising means of retaining said at least one covering slab with respect to said closing plate.

4. The construction according to claim 1, wherein said at least one second mounting element is arranged proximate to the opposite edge of said closing plate with respect to the edge proximate to which said at least one first mounting element is arranged.

5. The construction according to claim 1, wherein said at least one first mounting element comprises a tab that protrudes substantially at a right angle from an edge of said closing plate and defines, with its face directed toward said closing plate, said resting region.

6. The construction according to claim 1, wherein said at least one anchoring element comprises at least one engagement pin arranged, with its axis, substantially at a right angle to said covering slab and adapted to engage said at least one second mounting element.

7. The construction according to claim 6, wherein a recess for receiving said at least one engagement pin is defined in said at least one second adjustment element.

8. The construction according to claim 6, wherein said at least one engagement pin is provided with a pair of abutment shoulders for said second adjustment element, which are mutually facing and mutually spaced apart along the axis of said pin, and an accommodation recess being adapted to engage the portion of said engagement pin comprised between said abutment shoulders.

9. The construction according to claim 6, wherein said at least one engagement pin is axially provided with a threaded seat coupled to a threaded rod that is integral with said covering slab and extends substantially at right angles to said covering slab.

10. The construction according to claim 3, wherein said retention means comprise at least one hook element that is integral with said covering slab and at least one retention element that is supported by said closing plate and is adapted to interact with said hook element.

11. The construction according to claim 10, wherein said at least one first mounting element comprises a supporting body, and wherein said retention element comprises a screw element arranged substantially parallel to said closing plate and engaged with a threaded hole defined in said supporting body, said screw element being adapted to interact with an end thereof with said hook element.

12. The construction according to claim 1, comprising at least two second mounting elements arranged mutually spaced apart along an edge of said closing plate.

13. The construction according to claim 1, wherein said supporting structure comprises a plurality of box-like enclosures that internally define a respective accommodation cavity and are mutually arranged in vertical columns and horizontal rows.

* * * * *